United States Patent [19]

Der Estephanian

[11] Patent Number: 4,833,734

[45] Date of Patent: May 30, 1989

[54] LOW COST, HIGH PERFORMANCE SWEATBAND

[76] Inventor: Mark Der Estephanian, 1389 E. Washington Blvd., Pasadena, Calif. 91104

[21] Appl. No.: 40,933

[22] Filed: Apr. 21, 1987

[51] Int. Cl.[4] ..... A41D 13/00

[52] U.S. Cl. ..... 2/171; 2/22; 2/170; 2/DIG. 11; 2/181

[58] Field of Search ..... 2/171, 174, 198, 170, 2/DIG. 11, 181, 22

[56] References Cited

U.S. PATENT DOCUMENTS

| | | | |
|---|---|---|---|
| 2,445,209 | 7/1948 | Clark | 2/181 X |
| 4,394,782 | 7/1983 | Wasson | 2/181 |
| 4,441,214 | 4/1984 | Werner et al. | 2/174 |
| 4,499,741 | 2/1985 | Harris | 2/DIG. 11 X |
| 4,656,671 | 4/1987 | Manges | 2/DIG. 11 X |
| 4,698,852 | 10/1987 | Romero | 2/171 |

FOREIGN PATENT DOCUMENTS

| | | | |
|---|---|---|---|
| 2390116 | 12/1978 | France | 2/DIG. 11 |

OTHER PUBLICATIONS

WO86/00197, Haire, "Absorbent Headband or Sweatband", Jan. 1986.

*Primary Examiner*—Peter Nerbun

*Attorney, Agent, or Firm*—Louis J. Bachand

[57] ABSTRACT

A low cost sweatband is provided formed of an elastic fabric core of a length to resiliently encircle the head or wrist, and a low strength, highly absorbent paper fabric cover of excess length which is gathered into a cushioning, absorbent pad by stitching onto the elastic fabric.

11 Claims, 1 Drawing Sheet

LOW COST, HIGH PERFORMANCE SWEATBAND

TECHNICAL FIELD

This invention has to do with improvements in sweat bands used by athletes, joggers, tennis players and workers in certain occupations for control of perspiration flow into the yes or onto the grip of rackets and tools. More particularly, the invention relates to sweatband improvements comprising the use of low cost fabric, particularly paper fabrics.

BACKGROUND

A wide variety of goods have been pressed into service to keep perspiration from running into the eyes, from the bandanas of the cowboy to the sailor's hat, and more recently specialized bands have come into vogue which absorb the moisture and block its flowing. These recent bands have featured advertising for the maker or an unrelated business or cause. Typically known sweatbands have in common a costliness which dictates that they be washed and reused. Among the patents on sweatbands and similar purpose products are U.S. Pat. No. 2,783,474 to Campagna, U.S. Pat. No. 3,578,736 to Dootson, U.S. Pat. No. 4,244,057 to Burnham, U.S. Pat. No. 4,499,741 to Harris, U.S. Pat. No. 4,502,156 to Wishman, and U.S. Pat. No. 4,517,685 to Lesley. These patents, in general, disclose means which are intricate to manufacture, require special materials, or are cumbersome in fabrication and which as a result are too costly to be simple throwaway sweatbands.

There exists therefore a need for a low cost, but effective sweatband for brow, wrist or ankle, which is of such low cost as to be disposible like tissues or lens cleaners and which may be sold in packs as opposed to individually.

SUMMARY OF THE INVENTION

It is therefore an object of the present invention to provide a low cost, disposible sweatband of great effectiveness. It is another object to provide in such a sweatband a construction enabling manufacture from paper, on conventional machinery, at high speeds and at a consequent low cost. Still another object is to provide a sweatband having a cushioned water absorbent pad defined by a nonelastic paper gathered onto an elastic cloth fabric substrate.

More particularly, the invention provides a low cost sweatband comprising a relatively high tear strength, low water absorbency elastic fabric such as lycra brand spandex of a length to resiliently encircle the body part to be protected such as a head, ankle or wrist, an overlength low tear strength, high water absorbency, nonelastic paper laid onto the body-facing side of the elastic fabric, the elastic fabric and the paper being sewn together in paper fabric gathering relation such that the fabrics are the same length when sewn, the nonelastic paper fabric defining a cushioning, absorbent pad on the elastic fabric and expanding and contracting in concert with the elastic fabric when the elastic fabric is stretched or released respectively, the paper fabric absorbing perspiration in use supported by the elastic fabric against tearing when wet.

In this and like embodiments, the elastic fabric is a cloth fabric having inelastic or elastic threads therein in the longitudinal direction, the paper is nonwoven and has relatively low tear strength, e.g. less than 1000 grams/in. strip breaking load in the cross machine direction, the paper and the elastic fabric are sewn together longitudinally in parallel rows of stitching and free of cross stitching.

In another embodiment, the invention provides a low cost sweatband comprising a relatively high tear strength, low water absorbency elastic fabric of a length to resiliently encircle the body part to be protected such as a head, ankle or wrist, and a low tear strength, high water absorbency, nonelastic paper, the paper being relatively longer than the elastic and sewn longitudinally therewith wrapped therearound in overlapped relation and gathered to be coterminous with the elastic fabric in cushioning water absorbing pad defining relation, the nonelastic paper fabric expanding and contracting in concert with the elastic fabric when the elastic fabric is stretched or released respectively, the paper absorbing perspiration in use supported by the elastic fabric against tearing when wet.

In this as in other embodiments, the elastic fabric is a cloth fabric having inelastic or elastic threads therein in the longitudinal direction, the paper is nonwoven and has relatively low tear strength, the paper and the elastic fabric are sewn together longitudinally in parallel rows of stitching and free of cross stitching.

THE DRAWING

The invention will be further described as to an illustrative embodiment in conjunction with the attached drawing in which, FIG. 1 is a side elevation view of the sweatband in position on a user's head;

PREFERRED MODES

Figure 2:
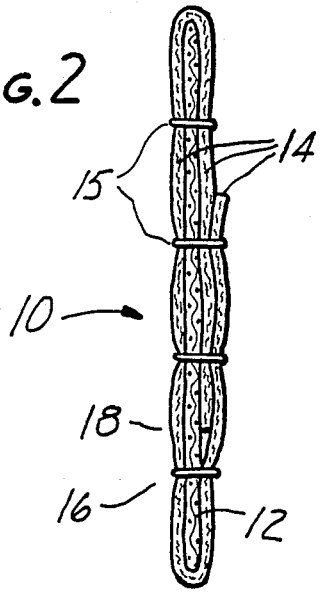
FIG. 2 is a view taken on line 2—2 in FIG. 1.

With reference now to the drawings, in FIGS. 1–4 the sweatband is shown at 10. While shown in a headband use, the band can be placed anywhere that control of perspiration is desired, such as the wrist or the ankle. The sweatband 10 comprises an inner layer of cloth fabric 12, an elastic cloth have elasticized threads such that the fabric 12 will elongate at least 50% in the longitudinal direction, or more up to 150%, as may be required to resiliently encircle and gently embrace the head, wrist etc. of the wearer, in supporting relation. The sweatband 10 further comprises an outer layer, or layers, 14. Typically, the outer layer is wrapped one or more times around the inner layer 12, as shown in FIG. 2, to provide multiple layers of the absorbent paper, but a single outer layer only on the inside of the band 10 may be used where low absorbency requirements are anticipated.

The length of the elastic, cloth fabric of layer 12 is suitably such as will enable the band to comfortably encircle the head, wrist etc. with the particular resiliency of the fabric being borne in mind. The length of the nonelastic, high absorbency paper of layer 14 on the other hand is overlength, typically by 100% to 200% or more. The purpose of this excess length is to permit gathering of the nonelastic fabric in fastening it to the inner layer 12 cloth fabric.

The gathering, which may be accomplished by a conventional elastic thread stitching machine stitching thread 15 through te assembled layers 12, 14, produces puffs 16 and puckers 18 in the paper layer 14 and provides a cushioned effect in use, as well as adds bulk but not length to the construction of the sweatband 10, so that it is comfortable in use and effective in absorbing perspiration.

The inner and outer layers 12, 14 are stitched longitudinally as shown, typically by longitudinal inelastic cotton threads 15, and not transversely, the transverse width being determined by the width of the inner elastic fabric layer 12. An elasticized form of thread 15 stitched through the outer inelastic layer 14 may be used as an elastic fabric to define the inner elastic layer 12.

Figure 1:
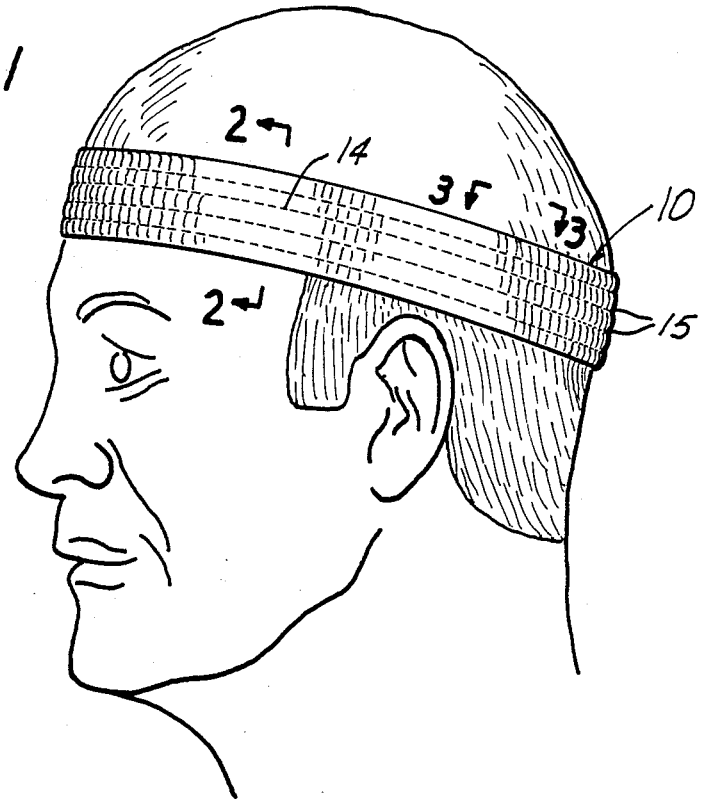
Figure 3:
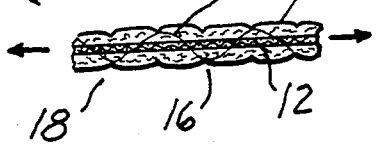
FIG. 3 is a view taken on line 3—3 in FIG. 1.
Figure 4:
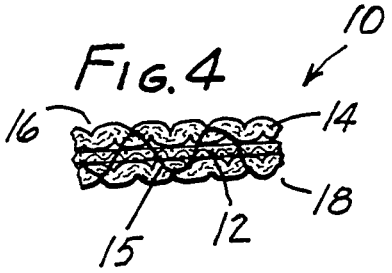
FIG. 4 is a view like FIG. 3, but of the sweatband in the relaxed state.

As best shown in FIGS. 3 and 4, the construction of the sweatband 10 is such that upon stretching over the wearer it elongates and thins down, while when relaxed it tightens upon itself. The puckers 16 and puffs 18 characteristic of a shirred fabric remain however in the thinned down state to cushion the user and to provide absorption.

As noted above, the inner layer 12 is of elasticized material, and preferably a woven cloth containing elastic fibers. The outer layer 14 which may be wrapped one or more times around the inner layer 12 typically comprises a low cost paper, which is highly absorbent of moisture, usually nonwoven and suitably of low strength from the absence of costly strengthening fibers. The low strength of the paper layer 14 is not important to the successful use of the sweatband 10, because whatever strength is needed is found in the inner layer 12 woven cloth. Conversely, the lack of good water absorption in the elasticized thread containing inner layer 12 fabric is satisfactory because the outer layer 14 provides all the needed absorbency for the sweatband 10.

Similarly, the lack of elasticity in the outer layer 14 is compensated for by the elasticity in the inner layer 12, and the cushiness induced in the outer layer 14 by the gathering stitching compensates for the lack of cushioning in the inner layer 12.

A typical outer layer 14 material will be a bonded crepe of 100% cellulose with a weight of 30 to 100 and preferably 45 grams per square yard, a thickness of 10 to 60 and preferably 27.5 mils, a water absorbtive capacity of 250% to 1000% and preferably 650%, a strip breaking load of 400 to 1000 and preferably 565 grams per inch in the cross machine direction wet, and of 500 to 1500 and preferably 765 in the machine direction, and a strip elongation of 5% to 30% and preferably 15%, per ASTM D-3776-79, D-1777-75, ASTM D-1682-64, ASTM D-1117-80.

The sweatband 10 is intended to be disposable after a single use, but may be used more than once. Its low cost construction is in contrast to knitted or specially woven constructions which are so costly as to preclude disposal after a single wearing.

The sweatbands provided are also readily adapted to promotional use, since their low cost enables them to be given away as premiums, and their comfort will induce recipients to wear them and thus to promote the product advertised thereon.

I claim:

1. A low cost sweatband comprising a relatively high tear strength, low water absorbency elastic fabric of a length to resiliently encircle the body part to be protected such as a head, ankle or wrist, an overlength low tear strength, high water absorbency, nonelastic paper laid onto the body-facing side of said elastic fabric, said elastic fabric and said paper being coextensive and sewn together in paper gathering relation such that said paper and fabric are the same length when sewn, said nonelastic paper defining a cushioning, absorbent pad on said elastic fabric and expanding and contracting in concert with said elastic fabric when said elastic fabric is stretched or released respectively, said paper absorbing perspiration in use is supported by said elastic fabric against tearing when wet and said fabric elasticity compensates for a lack of elasticity in said paper.

2. Low cost sweatband according to claim 1, in which said elastic fabric is a cloth fabric having elastic threads therein in the longitudinal direction.

3. Low cost sweatband according to claim 1, in which said paper is nonwoven and has relatively low tear strength.

4. Low cost sweatband according to claim 1, in which said paper and said elastic fabric are sewn together longitudinally in parallel rows of stitching and free of cross stitching.

5. Low cost sweatband according to claim 4, in which said paper and fabric are sewn with elasticized thread.

6. A low cost sweatband comprising a relatively high tear strength, low water absorbency elastic fabric of a length to resiliently encircle the body part to be protected such as a head, ankle or wrist, and a low tear strength, high water absorbency, nonelastic paper, said paper being relatively longer than said elastic fabric and sewn longitudinally therewith and wrapped therearound in overlapped coextensive relation and gathered to be coterminous with said elastic fabric, said nonelastic paper defining a cushioning, water absorbing pad expanding and contracting in concert with said elastic fabric when said elastic fabric is stretched or released respectively, said paper absorbing perspiration in use is supported by said elastic fabric against tearing when wet.

7. Low cost sweatband according to claim 6, in which said elastic fabric is a cloth fabric having elastic threads therein in the longitudinal direction.

8. Low cost sweatband according to claim 7, in which said paper is nonwoven and has relatively low tear strength.

9. Low cost sweatband according to claim 8, in which said paper and said elastic fabric are sewn together longitudinally in parallel rows of stitching and free of cross stitching.

10. Low cost sweatband according to claim 9, in which said fabrics are sewn with elasticized thread.

11. A low cost sweatband comprising a relatively high tear strength, low water absorbency elastic of a length to resiliently encircle the body part to be protected such as a head, ankle or wrist, and an overlength low tear strength, high water absorbency, nonelastic paper crepe having a weight of at least 30 grams per square yard, a thickness of 10 to 60 mils, and a water absorptive capacity of 250 to 1000%, said elastic fabric and nonelastic paper being coextensive and sewn in paper gathering relation, said nonelastic paper defining a cushioning, absorbent pad on said elastic and expanding and contracting in concert with said elastic when said elastic is stretched or released respectively, said paper absorbing perspiration in use is supported by said elastic against tearing when wet.

* * * * *